United States Patent [19]

Inokuchi et al.

[11] Patent Number: 4,702,780

[45] Date of Patent: Oct. 27, 1987

[54] PROCESS FOR PRODUCING A GRAIN ORIENTED SILICON STEEL SHEET EXCELLENT IN SURFACE PROPERTIES AND MAGNETIC CHARACTERISTICS

[75] Inventors: Yukio Inokuchi; Shigeko Ikeda; Yoh Ito, all of Chiba, Japan

[73] Assignee: Kawasaki Steel Corporation, Kobe, Japan

[21] Appl. No.: 695,456

[22] PCT Filed: Dec. 14, 1984

[86] PCT No.: PCT/JP84/00599

§ 371 Date: Jan. 15, 1985

§ 102(e) Date: Jan. 15, 1985

[30] Foreign Application Priority Data

Jun. 20, 1983 [JP] Japan ..... 58-109177

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 3,287,184 | 11/1966 | Koh | 148/111 |
| 3,872,704 | 3/1975 | Ohya et al. | 148/111 |
| 4,108,694 | 8/1978 | Shiozaki et al. | 148/111 |
| 4,280,856 | 7/1981 | Inokuti et al. | 148/111 |
| 4,469,533 | 9/1984 | Inokuti et al. | 148/111 |

FOREIGN PATENT DOCUMENTS

| | | | |
|---|---|---|---|
| 55-34633 | 3/1980 | Japan | 148/111 |
| 56-72126 | 6/1981 | Japan | 148/111 |

*Primary Examiner*—John P. Sheehan

*Attorney, Agent, or Firm*—Balogh, Osann, Kramer, Dvorak, Genova & Traub

[57] ABSTRACT

This invention realizes the improvement of the surface properties and the magnetic characteristics in such a way that a large amount of Si of 3.1–4.5% is incorporated into a raw material, a small amount of Al and a very small amount of S or Se are used as inhibitor together with Mo, and the slab heating is so performed at a temperature of not lower than 1,270° C. that the scale loss may reach 2.7–5.0%, whereby the inhibitor is fully dissociated and solid-solved to conspicuously strengthen the growth inhibiting effect against the primary recrystallization grains in the secondary recrystallization annealing for promoting the growth of the secondary recrystallization grains in the {110}<001> orientation, thereby forming the secondary recrystallization texture extremely strongly arranged in the {110}<001> orientation, so that a high magnetic flux density and a low iron loss is attained with effectively preventing cracks in hot rolling after slab soaking.

1 Claim, 2 Drawing Figures

Magnetic Characteristics
- ◎ $B_{10}$:>1.94T, $W_{17/50}$:<1.00W/kg
- ◉ $B_{10}$:>1.92T, $W_{17/50}$:<1.05W/kg
- ⊖ $B_{10}$:>1.89T, $W_{17/50}$:<1.10W/kg
- ● $B_{10}$:>1.89T, $W_{17/50}$:<1.20W/kg Surface Properties
- ○ Good
- △ Slightly Good
- × Bad

PROCESS FOR PRODUCING A GRAIN ORIENTED SILICON STEEL SHEET EXCELLENT IN SURFACE PROPERTIES AND MAGNETIC CHARACTERISTICS

TECHNICAL FIELD

The present invention relates to a grain oriented silicon steel sheet aiming at the improvement of the surface properties and the magnetic characteristics of a high silicon steel containing not less than 3.1% by weight (hereinafter referred to briefly as "%" of Si).

BACKGROUND ART

As well known, the grain oriented electromagnetic steel sheet which is mainly used as an iron sheet for the transformers is required to have a high magnetic flux density represented by $B_{10}$ value as the magnetization characteristics, a low iron loss represented by $W_{17/50}$ value, and excellent surface properties of a product steel sheet. In order to enhance the magnetic characteristics of the grain oriented silicon steel sheet as mentioned above, it is necessary to highly arrange the <001> axis of the secondary recrystallized grains of the product in a rolling direction. There have been heretofore huge improvements for this purpose, and it has now become possible to industrially produce a gain oriented silicon steel sheet having $B_{10}$ value of larger than 1.89 T (Tesla) and an iron loss of $W_{17/50}$ value of not higher than 1.05 W/kg. However, recently from the standpoint of the energy saving, it has been strongly demanded to lower the electric power loss than as before with respect to the electric appliances such as the transformers, and accordingly with respect to the grain oriented silicon steel sheet as the iron core material of the transformer and the like, there has been also demanded the one having a further lower iron loss value. In addition, there has been demanded to reduce the surface defects such as surface flawns and form an excellent insulating film with respect to the surface properties of the product.

On the other hand, the ultimate aim to have Si contained in the grain oriented silicon steel sheet is to increase the electric resistance of the raw material and to thereby lower the eddy current loss, that is, to reduce the iron loss. Therefore, to increase the content of Si is extremely effective to reduce the iron loss value. However, the increase in the content of Si leads to the problem that the surface properties of the steel sheet is deteriorated. That is, in the case of the process of making the grain oriented silicon steel sheet by using the AlN precipitation phase as an inhibitor, the slab is generally required to be heated at a higher temperature than in the ordinary steel prior to hot rolling in order to dissociate and solid-solve MnS to be coexistent as an inhibitor with AlN. However, if the slab is heated at such a higher temperature, it is likely that hot tear is produced during the slab soaking or hot rolling to develop the surface defects on the product. Particularly, if the content of Si exceeds 3.0%, the surface properties of the product conspicuously degrades with the rapid deterioration of the hot processability. Therefore, it has been so far compulsory that the content of Si is restricted to not higher than 3.0% so as to obtain the product having excellent surface properties. Thus, it has been considered to be actually difficult to reduce the iron loss value by further increasing the content of Si.

DISCLOSURE OF THE INVENTION

Based on the above-mentioned present situation, it is an object of the present invention to provide a process for manufacturing a grain oriented silicon steel sheet being extremely excellent in the surface properties thereof and low in iron loss by exceedingly stable steps.

Noting that a silicon steel raw material containing as much as 3.1–4.5% of Si when AlN precipitation phase being utilized is a material which is intrinsically suitable for the production of a product with a high magnetic flux density and a low iron loss, the present inventors have strenuously made experiments and studies to find out solutions for diminishing the deterioration in the surface properties which is the defect in this case. Consequently, they have found that even when a high content of Si is contained, the grain oriented silicon steel sheet having the excellent surface properties, high magnetic flux density and low iron loss can be obtained by adding a small amount of Mo into the raw material and putting a special modification upon the heating treatment of a slab prior to hot rolling, and have accomplished the invention.

The gist of the invention is as follows:

That is, the present invention is a process for manufacturing a grain oriented silicon steel sheet being excellent in the surface properties and magnetic characteristics, which is characterized by steps of: heat treating a raw slab for a silicon steel sheet which raw slab has a composition containing 0.01–0.08% of C, 3.1–4.5% of Si, 0.005–0.06% of sol Al, 0.003–0.1% of Mo and 0.005–0.1% in total amount of one or two kinds of S and Se at a heating temperature of not lower than 1,270° C. such that the scale loss, that is, the reduction percentage of the weight of the slab between before and after the heat treatment may be 2.7–5.0%, and then hot rolling the resultant; continuously annealing the resultant at a temperature range of 950°–1,200° C. prior to a final cold rolling, followed by quenching; subjecting the resultant to the cold rolling at a draft of 80–95% including a warm rolling at a temperature range of 250°–400° C. to obtain a final sheet thickness; and performing a finish annealing including a primary recrystallization annealing also serving as decarburization and a secondary recrystallization in the ordinary way.

Experimental results from which the invention has been originated will be explained below.

Each of a steel slab (A) having a composition containing 0.049% of C, 3.47% of Si, 0.030% of Al, 0.016% of Mo, 0.078% of Mn and 0.026% of S and a steel slab (B) having a composition containing 0.49% of C, 3.42% of Si, 0.029% of Al, 0.076% of Mn and 0.025% of S was heated at various temperatures in a range of 1,150° C.–1,400° C. and hot rolled to obtain a hot rolled sheet of 2.3 mm, which was homogeneously and continuously annealed at 1,150° C. and quenched, and subjected to a strong cold rolling at a draft of about 87% including a warm rolling at 250° C. on the midway of the cold rolling to be converted into a final cold rolled sheet of 0.3 mm in thickness. The cold rolled sheet was decarburization annealed at 840° C. in wet hydrogen, and then finish annealed by a box annealing at 1,200° C. to obtain a grain oriented silicon steel sheet.

Results upon examination of the magnetic characteristics and the surface properties with respect to the thus obtained steel sheets are plotted respectively in FIGS. 1*a* and 1*b* in connection with relation between the scale loss and the heating temperature of the slab.

As obvious from FIG. 1*a*, when the heating temperature is not lower than 1,270° C. and the scale loss is not smaller than 2.7%, the magnetic characteristics and the surface properties of the slab (A) are both excellent. It is particularly noted that the steel sheet having excellent magnetic characteristics of $B_{10}$ being not lower than 1.94 T and $W_{17/50}$ being not higher than 1.00 W/kg can be obtained when the heating temperature is in a range of 1,300°–1,400° C. and the scale loss is in a range of 3.0–4.4%. On the other hand, with respect to the slab (B), as shown in FIG. 1*b*, it is understood that excellent magnetic characteristics of $B_{10}$ being not lower than 1.92 T and $W_{17/50}$ being not higher than 1.05 W/kg can be obtained when the heating temperature is not lower than 1,300° C. and the scale loss is not lower than 3.2%, but the surface properties at that time are poor.

Examination upon the intergranular fracture after the high temperature impact tests when the above slabs (A) and (B) were subjected to the heat treatment at a heating temperature of 1,300° C. such that the scale losses were 3.0% and 3,2% respectively was conducted, and the following results were obtained That is, while the steel slab (A) into which Mo was added was completely free from surface cracks and excellent in the surface properties, many surface cracks were formed in the slab (B) into which no Mo was added. These results were well in conformity with those of the surface properties of the products shown in FIG. 1.

As mentioned above, it is understood that the magnetic characteristics and the surface properties are both excellent when the scale loss is not lower than 2.7% in the case of heating the slab at a temperature of not lower than 1,270° C. Namely, the addition of a small amount of Mo into the raw material not only effectively plays the role as inhibitor together with the AlN precipitation phase, but also can eliminate the deterioration of the surface properties which are to be caused in the case of a high temperature heating with the content of Si being high. The reinforcement of the inhibitor with the Mo added in the former role is considered to be due to the same mechanism previously proposed by the inventors in Japanese Patent Application Publication No. 14,737/1982 as in the case of the combined addition of Mo, Sb and Se or S, that is, the inhibiting effect against the primary crystallized grains is remarkably strengthened by the combined addition of a small amount of Mo and Al, so that eminent effect is exhibited for the growth of the secondary grains in the {110}<001> orientation at the time of the secondary recrystallization annealing. Further, the prevention of the deterioration of the surface properties by the addition of the Mo in the latter role is considered to be based on that the surface defects can be effectively prevented through the preferential precipitation of the fine precipitates of Mo sulfide (probably $Mo_2S_3$) compound at the steel sheet surface or in the vicinity thereof, even when the heating is done at a high temperature with the content of Si being high.

In the conventional heating treatment prior to the hot rolling, the heating temperature was set about 1,150°–1,250° C. and the scale loss was about 1.5–2.5% taking the economy in the heating into account.

The reasons why the fundamental ingredients of the raw slab are restricted as mentioned above in the present invention will be explained below.

C: 0.01–0.08

C is an element playing an important role in controlling a fine and uniform structure at hot rolling or cold rolling. If it is more than 0.08%, it takes a long time to perform the decarburization-annealing prior to the secondary recrystallization annealing, thereby lowering the productivity and damaging the magnetic characteristics due to insufficient decarburization. On the other hand, if the content is less than 0.01%, it becomes difficult to control the texture at the time of the hot rolling, so that large elongated grains are formed to deteriorate the magnetic characteristics. Thus, the content of C is restricted to a range of 0.01–0.08%.

Si: 3.1–4.5%

As mentioned above, since Si is an element which is extremely effective for increasing the electric resistance of the raw material to reduce the eddy current loss, not lower than 3.1% of Si is contained in the present invention. If the content of Si exceeds 4.5%, brittle fractures are likely to be formed at the time of the cold rolling. Thus, the content of Si is restricted to 3.1–4.5%. As mentioned above, the content of Si in the conventional grain oriented silicon steel sheet containing Al is 2.8–3.0%, and when the content of Si is increased and the heating is done at a higher temperature, the surface properties of the product is conspicuously deteriorated. In this respect, the occurrence of the surface defects can be prevented even at a high content of Si being 3.1–4.5% by the addition of a small amount of Mo according to the present invention.

sol Al: 0.005–0.06%

When Al is contained in the steel, it bonds with N to form a fine precipitate of AlN and acts as a powerful inhibitor. Particularly, in order that the secondary recrystallization may be developed by the strong cold rolling at a cold rolling draft of 80–95%, Al is required to be contained in a range of 0.005–0.06 in the form of sol Al. The reason is that while if Al is less than 0.005%, the precipitation amount of the AlN fine precipitate as the inhibitor is lacking to make insufficient the growth of the secondary recrystallization grains in the {110}<001> orientation, if Al exceeds 0.06%, the growth of the secondary recrystallization grains in the {110}<001> orientation becomes lower.

S and/or Se: 0.005–0.1%

S and Se form MnS and MnSe dispersion precipitation phases respectively to increase the inhibitor effect together with AlN. If the content of S and Se is less than 0.005% when added alone or in combination thereof, the inhibitor effect due to MnS and MnSe is weak. To the contrary, if the addition amount exceeds 0.1%, the hot rolling and cold rolling processibility is extremely deteriorated. Thus, S and Se are required to be in a range of 0.005–0.01% in a total amount of one or two of these elements.

Mo: 0.003–0.1%

If Mo is less than 0.003%, the growth inhibiting effect against primary recrystallization grain drops, and at the same time the surface properties of the steel sheet is deteriorated. On the other hand, if it is more than 0.1%, it is effective in the effect of preventing the deterioration of the surface properties of the steel sheet, but the processability at hot rolling and cold rolling is lowered and the insufficient decarburization at the time of the decarburization-primary recrystallization annealing is likely to occur. Thus, Mo is required to be in a range of 0.003–0.1%.

Although the reasons for the compounding ranges of the fundamental ingredients have been explained, the present invention does not preclude the presence of other known elements which are ordinarily added in the silicon steel.

For instance, when Mn is contained in the steel, it bonds with S or Se to form fine precipitates of MnS and MnSe, and acts as a powerful inhibitor. If Mn is less than 0.02%, the precipitation amount of the fine precipitates of the MnS and MnSe as the inhibitor is lacking, so that the growth of the secondary recrystallization grains in the {110}<001> orientation becomes insufficient. On the other hand, if Mn exceeds 2%, MnS and the like are hardly dissociated and solid-solved in heating the slab, and even if the dissociation and the solid-solving takes place, MnS, MnSe and the like are hardly dissociated and solid-solved at the hot rolling or the dispersion precipitation phase deposited at the hot rolling is likely to be larger to damage the appropriate size distribution as the inhibitor and deteriorate the magnetic characteristics. From these reasons, the content of Mn is preferably about 0.02%–2%. One or two kinds of Sb and B which may be added into the oridinary silicon steel as the known primary recrystallization grain growth inhibitor may be contained in a total amount of not higher than about 0.03%. Besides, the general inevitable elements such as Cr, Ti, V, Zr, Nb, Ta, Co, Ni, Sn, P and As may be contained in a very small amount.

Next, a series of the manufacturing steps of the present invention will be explained.

As the means for melting the raw material used in the method according to the present invention, use may be made of the conventional steel-making furnace such as the LD converter, the open-hearth furnace and the like, which may be of course used in combination with the vacuum treatment on the vacuum melting. Further, as the slab-making means, use may be favorably made of the continuous casting in addition to the ordinary ingot making-slabbing method.

The silicon steel slab obtained as mentioned above is heated and then hot rolled according to the conventional method. The thickness of the hot rolled sheet obtained by this hot rolling depends upon the draft and so on in the succeeding cold rolling step, and is ordinarily about 2–5 mm. In the present invention, care should be given to the slab-heating prior to the above-mentioned hot rolling. That is, as mentioned above, the dissociation and solid-solving of the MnS, MnSe or the like contained in the raw material becomes extremely difficult in the case of the silicon steel sheet with a high content of Si or 3.1–4.5%, the heating is required to be fully done at a heating temperature of not lower than 1,270° C. in such a manner that the scale loss may be 2.7–5.0%.

After the hot rolled plate having undergone the above-mentioned hot rolling is subjected to the continuous annealing at a temperature range of 950°–1,200° C. for 30 seconds to 30 minutes for the purpose of homogenization of the structure and sufficient solid-solving of AlN, it is quenched. The quenching treatment after the annealing is necessary for the formation of the fine precipitation phase of AlN, and it is ordinarily desirable that quenching is carried out from a temperature range of 850°–1,050° C. to a temperature of not higher than 400° C.

The hot rolled steel sheet quenched in the above is subjected to the strong cold rolling at a draft of 80–95% to obtain a product sheet thickness. It is necessary that the warm rolling is performed at a temperature range of 200°–400° C. during the cold rolling. As disclosed in Japanese Patent Application Publication No. 13,846/1979, the deformation mechanism is changed through the fixing function of the dislocation by the Cottrell atmosphere which is formed through scatteringly collecting the C and N solid-solved into the silicon steel onto the defect portions formed during the warm rolling or the interruption of the dislocation movement due to the fine precipitates, so that the primary recrystallization texture which is advantageous for the secondary recrystallization is formed. The cold rolled sheet thus treated to have the final sheet thickness of about 0.1–0.5 mm is subjected to the decarburization-annealing serving also as the primary recrystallization at a temperature range of 750–870° C. This decarburization-annealing may be ordinarily carried out in a wet hydrogen gas atmosphere or a mixed gas atmosphere of hydrogen and nitrogen at a temperature higher by about 30°–65° C. than the dew point for a few minutes.

Next, an annealing separator mainly consisting of MgO is applied to the steel sheet after decarburization-annealing, which is subjected to the finish annealing to grow the secondary recrystallization grains in the {110}<001> orientation. The specific conditions of the finish annealing may be similar to those in the case of the conventional annealing, and preferably, are ordinarily that the temperature is raised at a temperature rising rate of 3°–50° C./hr up to 1,150°–1,250° C. and then the purification annealing is carried out in hydrogen for 5–20 hours.

As mentioned above, according to the present invention, it is possible to industrially and stably manufacture the grain oriented electromagnetic steel sheet with a high Si content having extremely excellent magnetic characteristics of the high magnetic flux density $B_{10}$ of not lower than 1.94 T and the extremely low iron loss $W_{17/50}$ of not higher than 1.00 W/kg with excellent surface properties.

BEST MODE FOR WORKING THE INVENTION

EXAMPLE 1

Figure 1A:
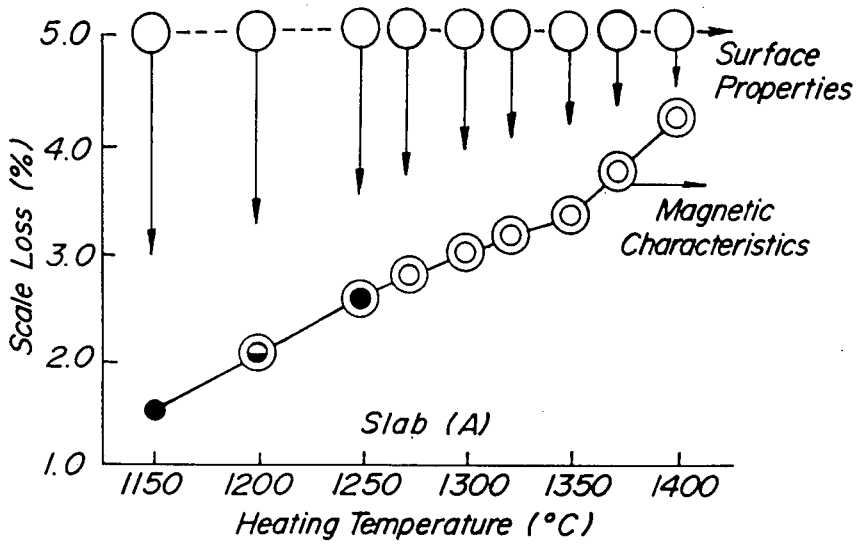
FIGS. 1*a* and 1*b* are graphs in which the magnetic characteristics and the surface properties of the silicon steel sheets obtained from the slabs (A) and (B) are shown in connection with the relation between the scale loss and the heating temperature.
Figure 1B:
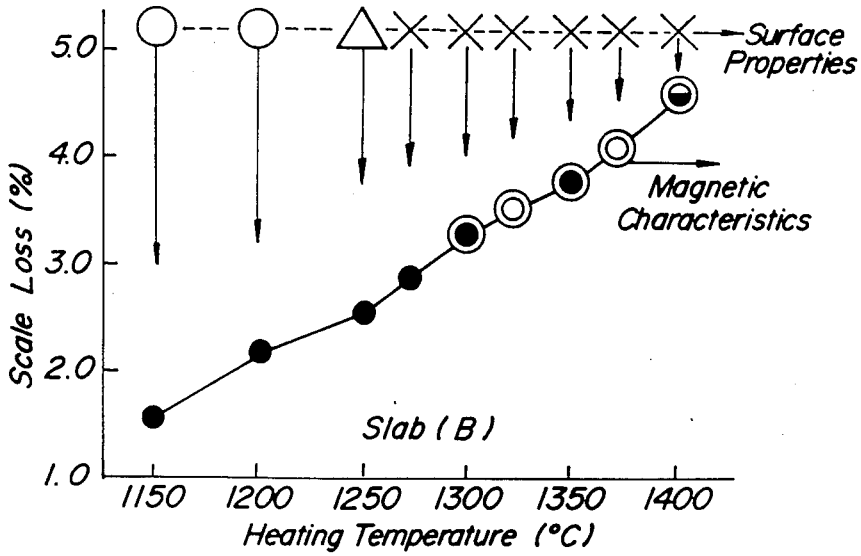

A continuously cast slab having a composition containing 0.049% of C, 3.48% of Si, 0.029% of Al, 0.018% of Mo, 0.076% of Mn and 0.026% of S was heated at 1,360° C. such that the scale loss might reach 3.5%, and then hot rolled to obtain a hot rolled sheet of 2.3 mm in thickness. Then, after having been subjected to the continuous annealing at 1.120° C., the steel sheet was subjected to the quenching treatment, and to the strong cold rolling at a draft of about 87% including a warm rolling at 250° C. to obtain a final cold rolled sheet of 0.3 mm in thickness. Thereafter, the cold rolled sheet was subjected to the decarburization-primary recrystallization annealing at 840° C. in wet hydrogen, and then finish annealed by the box annealing at 1,230° C.

The magnetic characteristics and the surface propeties of the thus obtained product were as follows:

Magnetic characteristics
$B_{10}$: 1.95 T,
$W_{17/50}$: 0.99 W/kg
Surface properties: good

EXAMPLE 2

A continuously cast slab having a composition containing 0.55% of C, 3.52% of Si, 0.025% of Al, 0.020% of Mo, 0.019% of Se and 0.070% of Mn was heated and annealed at 1,360° C. such that the scale loss might reach 3.8%, and hot rolled to obtain a hot rolled sheet of 2.3 mm in thickness. Then, after having been homogenization annealed at 1,160° C., the hot rolled sheet was subjected to a quenching treatment and then to a warm rolling at 320° C. to obtain a final cold rolled sheet of 0.3 mm in thickness. Thereafter, the cold rolled sheet was subjected to the decarburizationprimary recrystallization annealing at 840° C. in wet hydrogen, and the cold rolled sheet was coated with an annealing separator mainly consisting of MgO, and was heated at a rate of 10° C. from 800° C. to 1,150° C. to perform the secondary recrystallization. Subsequently, the purification annealing was performed at 1,200° C. in hydrogen for 5 hours. The magnetic characteristics and the surface properties of the thus obtained products were as follows:

Magnetic characteristics
$B_{10}$: 1.96 T,
$W_{17/50}$: 0.97 W/kg
Surface properties: good

EXAMPLE 3

A continuous cast slab having a composition containing 0.048% of C, 3.52% of Si, 0.029% of Al, 0.015% of Mo, 0.023% of Sb, 0.020% of Se and 0.073% of Mn was heated and annealed at 1.340° C. such that the scale loss might reach 3.2% and the hot rolled to obtain a hot rolled sheet of 2.3 mm in thickness. Then after having been homogenization annealed at 1,150° C., the steel sheet was subjected to a strong cold rolling at 87% to obtain a final cold rolled sheet of 0.3 mm in thickness. A warm rolling was carried out at 280° C. during the cold rolling. Therefore, the cold rolled sheet was subjected to a decarburization-primary recrystallization annealing at 840° C. in wet hydrogen, which was cooled with an annealing separator mainly consisting of MgO and heated at a rate of 15° C./h from 850° C. to 1,120° C. to effect the secondary recrystallization, followed by the purification annealing at 1,230° C. in hydrogen for four hours. The magnetic characteristics and the surface properties of the thus obtained product were as follows:

Magnetic characteristics
$B_{10}$: 1.95 T,
$W_{17/50}$: 0.98 W/kg
Surface properties: good

INDUSTRIAL APPLICABILITY

According to the present invention, it is possible to advantageously produce the grain oriented silicon steel sheet which is excellent in the magnetic characteristics, that is, the high magnetic flux density and the low iron loss without deteriorating the surface properties thereof, and therefore, when the silicon steel sheet thus obtained is applied to the use of the iron core for the transformer, it greatly contributes to the realization of the miniaturization and the energy saving thereof.

What is claimed is:

1. A process for manufacturing a grain oriented silicon steel sheet being excellent in the surface properties and magnetic characteristics, which is characterized by steps of: heat treating a raw slab for a silicon steel sheet which raw slab has a composition containing 0.01–0.08% of C, 3.1–4.5% of Si, 0.005–0.06% of sol Al, 0.003–0.1% of Mo and 0.005–0.1% in total amount of one or two kinds of S and Se at heating temperature of not lower than 1,270° C. such that the scale loss may be 2.7–5.0%, and then hot rolling the heat treated steel; continuously annealing the hot rolled steel at a temperature range of 950°–1,200° C. prior to a final cold rolling, followed by quenching; subjecting the quenched steel to the cold rolling at a draft of 80–95% including a warm rolling at a temperature range of 250°–400° C. to obtain a final sheet thickness; and performing a finish annealing including a primary recrystallization annealing also serving as decarburization and a secondary recrystallization.

* * * * *

UNITED STATES PATENT OFFICE

CERTIFICATE OF CORRECTION

PATENT NO. : 4,702,780

DATED : October 27, 1987

INVENTOR(S) : Yukio INOKUCHI, et al

It is certified that error appears in the above-identified patent and that said Letters Patent are hereby corrected as shown below:

Delete "Foreign Application Priority Data
Jun. 20, 1983 (JP) Japan ..... 58-109177".

Signed and Sealed this

Twenty-sixth Day of July, 1988

*Attest:*

DONALD J. QUIGG

*Attesting Officer*

*Commissioner of Patents and Trademarks*